US012274341B2

(12) United States Patent
Lee et al.

(10) Patent No.: US 12,274,341 B2
(45) Date of Patent: Apr. 15, 2025

(54) HEAD FOR CURLING HAIR AND HAIR STYLING DEVICE HAVING THE SAME

(71) Applicant: UNIX ELECTRONICS CO., LTD., Gimpo-si (KR)

(72) Inventors: Chung Gu Lee, Seoul (KR); Han Jo Lee, Seoul (KR)

(73) Assignee: UNIX ELECTRONICS CO., LTD., Gimpo-si (KR)

( * ) Notice: Subject to any disclaimer, the term of this patent is extended or adjusted under 35 U.S.C. 154(b) by 375 days.

(21) Appl. No.: 17/865,171

(22) Filed: Jul. 14, 2022

(65) Prior Publication Data

US 2023/0014059 A1 Jan. 19, 2023

(30) Foreign Application Priority Data

Jul. 15, 2021 (KR) ..... 10-2021-0092956

(51) Int. Cl.
*A45D 2/00* (2006.01)

(52) U.S. Cl.
CPC ..... *A45D 2/00* (2013.01)

(58) Field of Classification Search
CPC ... A45D 2/00; A45D 2/08; A45D 2/12; A45D 2/36; A45D 2/362; A45D 2/365; A45D 2/367; A45D 2002/025; A45D 4/06; A45D 4/10; A45D 4/12; A45D 4/18; A45D 20/50
See application file for complete search history.

(56) References Cited

U.S. PATENT DOCUMENTS

2015/0265023 A1* 9/2015 MacLaine ..... A46B 15/0051 132/212
2017/0273423 A1* 9/2017 Mason ..... A45D 20/00

FOREIGN PATENT DOCUMENTS

CN 111887565 A * 11/2020
KR 10-2016-0126073 A 11/2016
KR 10-2018-0121984 A 11/2018

* cited by examiner

*Primary Examiner* — Jacqueline T Johanas
*Assistant Examiner* — Jennifer P Connell
(74) *Attorney, Agent, or Firm* — NKL LAW; Jae Youn Kim

(57) ABSTRACT

The present disclosure relates to a hair curling head including a cylindrical head main body which has an inlet through which air enters, a plurality of slots which are formed in the head main body in a longitudinal direction thereof and formed in a circumferential direction of the head main body, and an internal insert which is inserted into the head main body and configured to guide air entering through the inlet toward the slots so that the air is discharged through the slots and flows along a surface of the head main body, and a hair styling device having the hair curling head.

12 Claims, 8 Drawing Sheets

HEAD FOR CURLING HAIR AND HAIR STYLING DEVICE HAVING THE SAME

CROSS-REFERENCE TO RELATED APPLICATION

This application claims priority to and the benefit of Korean Patent Application No. 10-2021-0092956, filed on Jul. 15, 2021, the disclosure of which is incorporated herein by reference in its entirety.

BACKGROUND

1. Field of the Invention

The present disclosure relates to a head for curling hair that blows air to allow a user's hair to be automatically curled and a hair styling device having the same.

2. Discussion of Related Art

Generally, a hair styling device is one beauty instrument used to style the user's hair beautifully, such as forming a curl or a partial wave on the user's hair according to the user's taste. Examples of the hair styling device may include a hair iron, a hot styling brush, or the like.

In recent years, a hair styling device having a form that blows air along a surface of a head and pulls and winds the hair using an aerodynamic phenomenon known as the "Coanda effect" so that the hair around the head is automatically wound and curled has been proposed and used. The hair styling device having such a form has advantages that, due to attracting and wrapping the hair with air, styling is possible without excessive heat damage, and since it is not necessary to use a bristled brush, the hair may slide away from the head when styling of the hair is completed and thus the hair does not get tangled.

In the hair styling device having the above form, allowing an appropriate volume of air to evenly flow in a direction along the surface of the head is a major factor that determines hair curling performance. Various attempts have been made to improve the hair curling performance in consideration of the above factor.

SUMMARY OF THE INVENTION

The present disclosure is directed to providing a head for curling hair that is capable of improving hair curling performance by evenly guiding air in a direction along a surface of the head with a simple configuration and a hair styling device having the same.

Objectives to be achieved by the present disclosure are not limited to the above-mentioned objective, and other unmentioned objectives should be clearly understood by those of ordinary skill in the art to which the present disclosure pertains from the description below.

One embodiment of the present disclosure discloses a hair curling head for a hair styling device, the hair curling head including a cylindrical head main body which has an inlet through which air enters, a plurality of slots which are formed in the head main body in a longitudinal direction thereof and formed in a circumferential direction of the head main body, and an internal insert which is inserted into the head main body and configured to guide air entering through the inlet toward the slots so that the air is discharged through the slots and flows along a surface of the head main body.

Also, the head main body may include a plurality of plate parts sequentially disposed in the circumferential direction, and the slots may be formed between the plurality of plate parts.

Also, the plate parts may each have the form of a curved panel whose inner surface is concave and outer surface is convex.

Also, the internal insert may include a plurality of guide plates which are disposed in the circumferential direction and a frame part which is configured to support the plurality of guide plates so that air blowing holes are formed between the plurality of guide plates.

Also, the guide plates may be configured to form a primary air blowing space which is formed between the guide plate and an arbitrary first plate part among the plate parts and which allows air entering through the air blowing holes to blow and be discharged through the slots and a secondary air blowing space which is formed between the guide plate and a second plate part adjacent to the first plate part and which is formed to have a space smaller than the primary air blowing space to allow some of the air of the primary air blowing space to blow.

Also, the guide plates may have a guide surface formed so that a gap from the second plate part is narrower than a gap from the first plate part.

Also, the guide surface of the guide plates may be disposed to overlap with the second plate part by as much as an area that corresponds to the secondary air blowing space.

Also, the air blown to the secondary air blowing space may enter the primary air blowing space of the second plate part.

Also, a plurality of guide ribs configured to induce air entering through the air blowing holes to be distributed into a plurality of airflows may be further formed on outer surfaces of the guide plates.

The guide ribs may be formed to be inclined at a certain angle with respect to a longitudinal direction of the internal insert.

Also, a plurality of blade parts configured to distribute air discharged through the slots into a plurality of airflows may be formed on the head main body.

Also, a guide protrusion configured to guide the air of the primary air blowing space toward the slots may be formed to protrude from the guide surface of the guide plates.

Also, the guide protrusion may be formed at a position spaced a predetermined distance apart from the position of the slot.

Meanwhile, another embodiment of the present disclosure discloses a hair styling device including a handle which is configured to be gripped by a user's hand and has a fan unit embedded therein to suction and blow air and a hair curling head which is attached to the handle and configured to discharge air for curling hair according to an operation of the fan unit, wherein the hair curling head includes a cylindrical head main body which has an inlet through which air enters, a plurality of slots which are formed in the head main body in a longitudinal direction thereof and formed in a circumferential direction of the head main body, and an internal insert which is inserted into the head main body and configured to guide air entering through the inlet toward the slots so that the air is discharged through the slots and flows along a surface of the head main body.

BRIEF DESCRIPTION OF THE DRAWINGS

The above and other objects, features and advantages of the present disclosure will become more apparent to those of ordinary skill in the art by describing exemplary embodiments thereof in detail with reference to the accompanying drawings, in which.

DETAILED DESCRIPTION OF EXEMPLARY EMBODIMENTS

Figure 1:
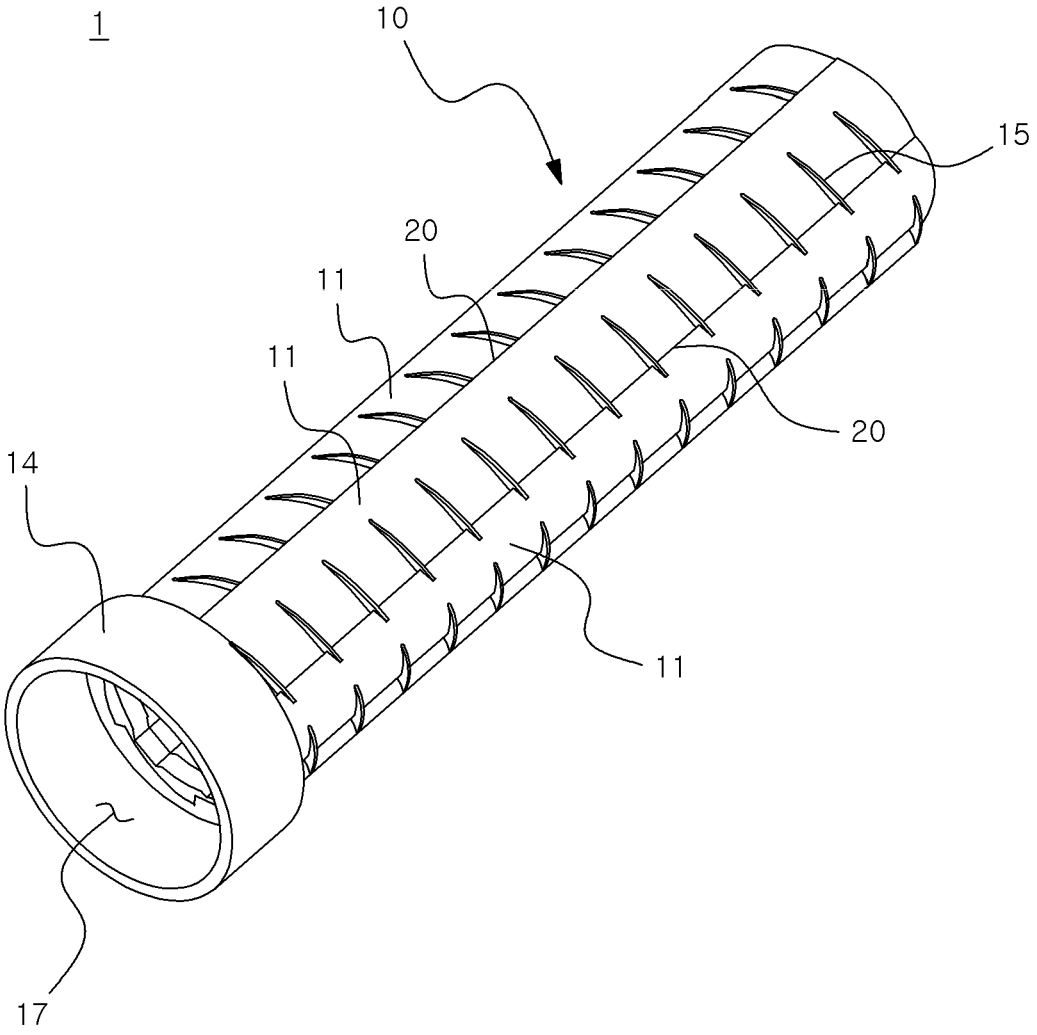
FIG. 1 is a perspective view of a hair curling head according to one embodiment of the present disclosure.

Since various modifications may be made to the present disclosure and the present disclosure may have various embodiments, specific embodiments are illustrated in the drawings and will be described in detail herein. However, this does not limit the present disclosure to the specific embodiments, and all modifications, equivalents, and substitutes included in the spirit and technical scope of the present disclosure should be construed as belonging to the present disclosure. In describing the present disclosure, when detailed description of a related known art is determined as having the possibility of obscuring the gist of the present disclosure, the detailed description thereof will be omitted.

Terms such as "first" and "second" may be used to describe various elements, but the elements are not limited by the terms. The terms are only used for the purpose of distinguishing one element from another element.

Terms used in this application are only used to describe specific embodiments and are not intended to limit the present disclosure. A singular expression includes a plural expression unless the context clearly indicates otherwise. In this application, terms such as "include" or "have" should be understood as specifying that features, number, steps, operations, elements, components, or combinations thereof are present and not as precluding the possibility of the presence or addition of one or more other features, numbers, steps, operations, elements, components, or combinations thereof in advance.

Hereinafter, embodiments of a hair curling head and a hair styling device having the same according to the present disclosure will be described in detail with reference to the accompanying drawings, and in describing the embodiments with reference to the accompanying drawings, the same or corresponding elements will be denoted by the same reference numerals and repeated description thereof will be omitted.

Figure 2:
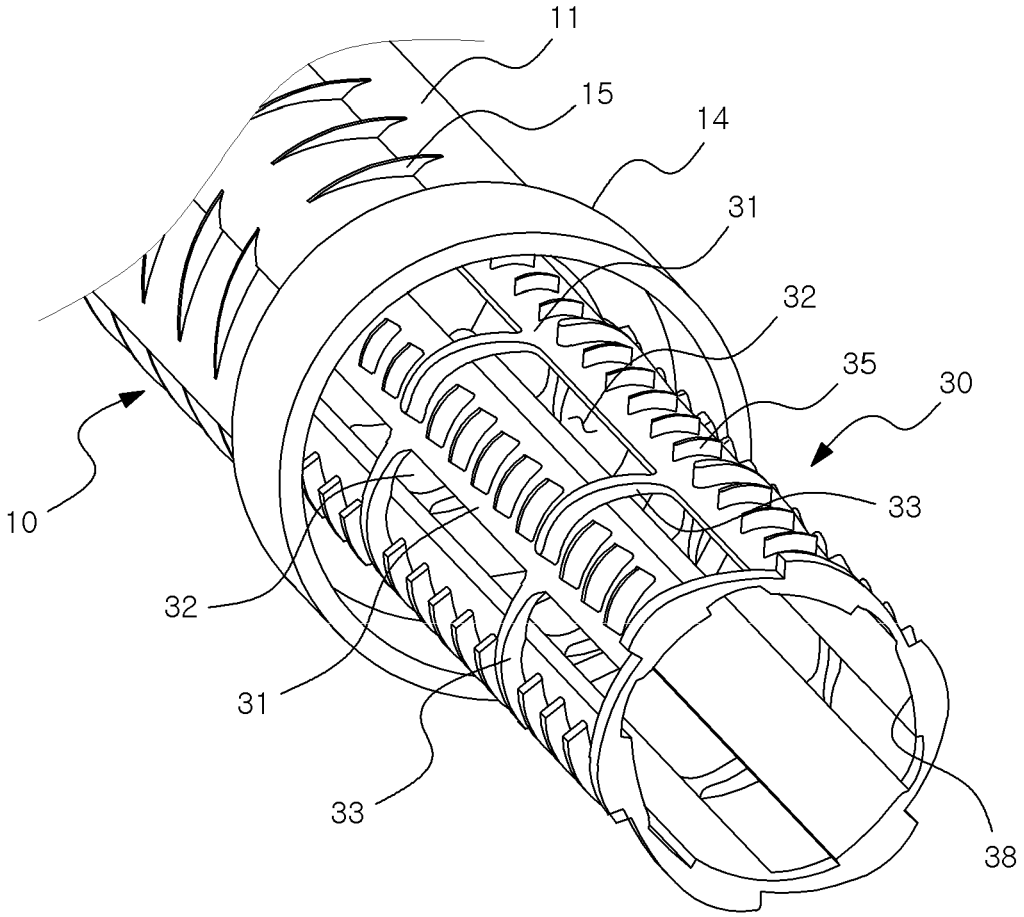
FIG. 2 is an exploded perspective view of a portion of the hair curling head illustrated in FIG. 1.

FIG. 1 is a perspective view of a hair curling head according to one embodiment of the present disclosure, and FIG. 2 is an exploded perspective view of a portion of the hair curling head illustrated in FIG. 1. Also, FIG. 3 is a perspective view of an internal insert illustrated in FIG. 2.

A hair curling head 1 according to the present embodiment is for a hair styling device. The hair curling head 1 is configured to be attachable to a handle 2 (see FIG. 8) of the hair styling device and serves to discharge air, which is generated according to an operation of a fan unit embedded in the handle 2, in a circumferential direction (a surface direction) of the head 1 so that the hair is curled.

Figure 3:
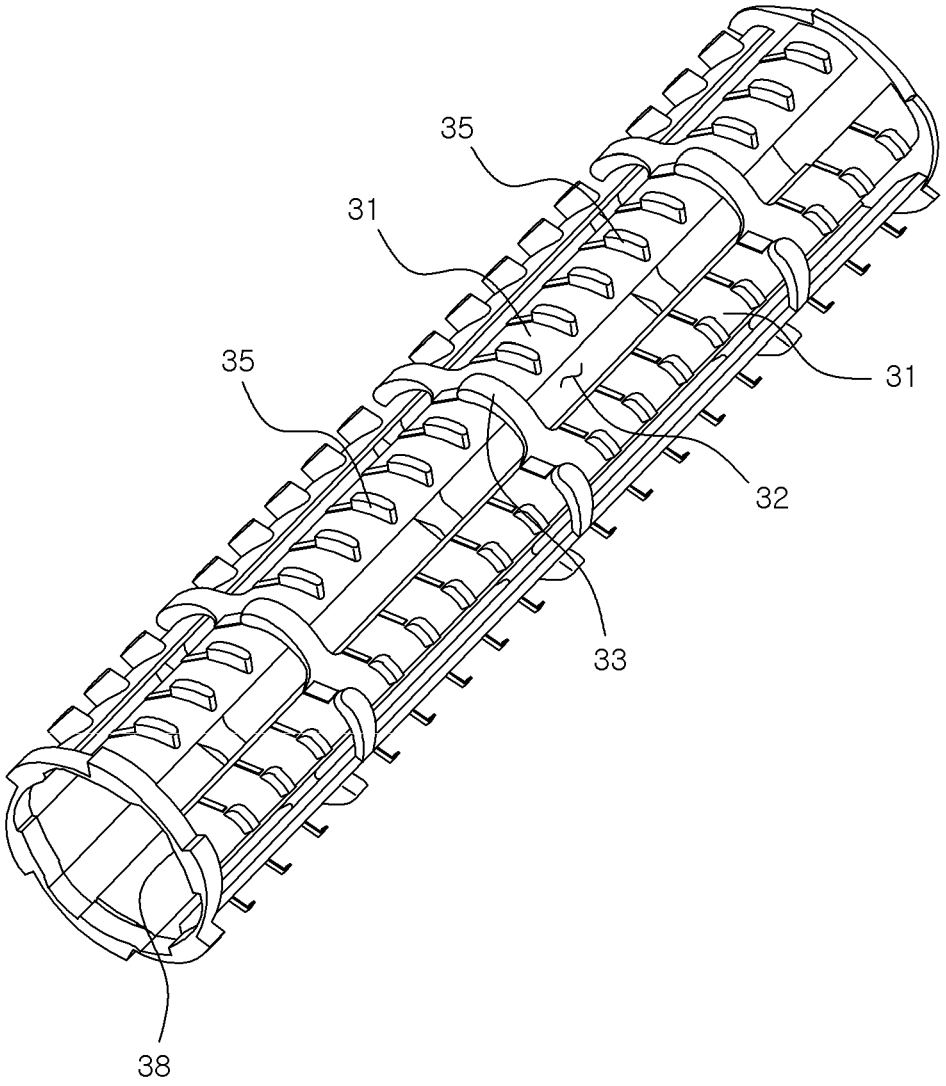
FIG. 3 is a perspective view of an internal insert illustrated in FIG. 2.

Referring to FIGS. 1 to 3, the hair curling head 1 according to the present embodiment includes a head main body 10, a plurality of slots 20, and an internal insert 30.

The head main body 10 has a cylindrical shape and has an inlet 17 through which air enters disposed at one end. A collar 14 may be formed at the inlet 17 of the head main body 10 and may be detachably coupled to the handle 2 of the hair styling device. The head main body 10 may have a structure in which the one end (that is, the air inlet) is open and the other end is closed.

The head main body 10 may have a form in which a plurality of plate parts 11 are sequentially disposed in the circumferential direction, and the plate parts 11 may each have the form of a curved panel whose inner surface is concave and outer surface is convex. According to the present embodiment, a structure in which six curved plates are sequentially disposed to form a cylindrical shape as a whole is illustrated (see FIG. 4), but the number of plates or a curvature thereof may be modified and be different from the present embodiment.

The plurality of slots 20 are formed in the head main body 10 in a longitudinal direction thereof and may be formed to be spaced a predetermined distance apart from each other in the circumferential direction of the head main body 10. The slots 20 are formed between the plate parts 11 and provide a space through which air blown in the head main body 10 is discharged.

The internal insert 30 is installed to be inserted into the head main body 10 and guides air entering through the inlet 17 of the head main body 10 so that the air is discharged through the slots 20 and flows along a surface of the head main body 10.

The internal insert 30 includes a plurality of guide plates 31 which are disposed in the circumferential direction and a frame part 33 which is configured to support the plurality of guide plates 31 so that air blowing holes 32 are formed between the plurality of guide plates 31. Due to such a structure, the guide plates 31 and the air blowing holes 32 are alternately disposed in the circumferential direction and form the cylindrical internal insert 30 as a whole. The internal insert 30 may have a smaller diameter than the head main body 10 in order to be inserted into the head main body 10 and may have a structure fitted and coupled to the head main body 10. The internal insert 30 has a structure in which one end has an inlet 38 formed through which air enters and the other end is closed.

A plurality of guide ribs 35 may be formed on outer surfaces of the guide plates 31, and the guide ribs 35 may be disposed at predetermined intervals in a longitudinal direction of the internal insert 30. The guide ribs 35 serve to induce air entering through the air blowing holes 32 to be distributed into a plurality of airflows, and in this way, the guide ribs 35 may make the flow of air uniform throughout the entire area of the guide plates 31 and increase a flow velocity.

The guide ribs 35 may have a form that is inclined at a certain angle with respect to the longitudinal direction of the internal insert 30, and in this way, the direction of air may be induced to be in a direction in which the guide ribs 35 are inclined.

Meanwhile, a plurality of blade parts 15 configured to distribute air discharged through the slots 20 into a plurality of airflows may be formed on the head main body 10. The plurality of blade parts 15 may be formed in an inclined shape at positions of outlets of the slots 20. Like the guide ribs 35 of the guide plates 31, the plurality of blade parts 15 also serve to make the flow of air uniform and increase the flow velocity.

Figure 4:
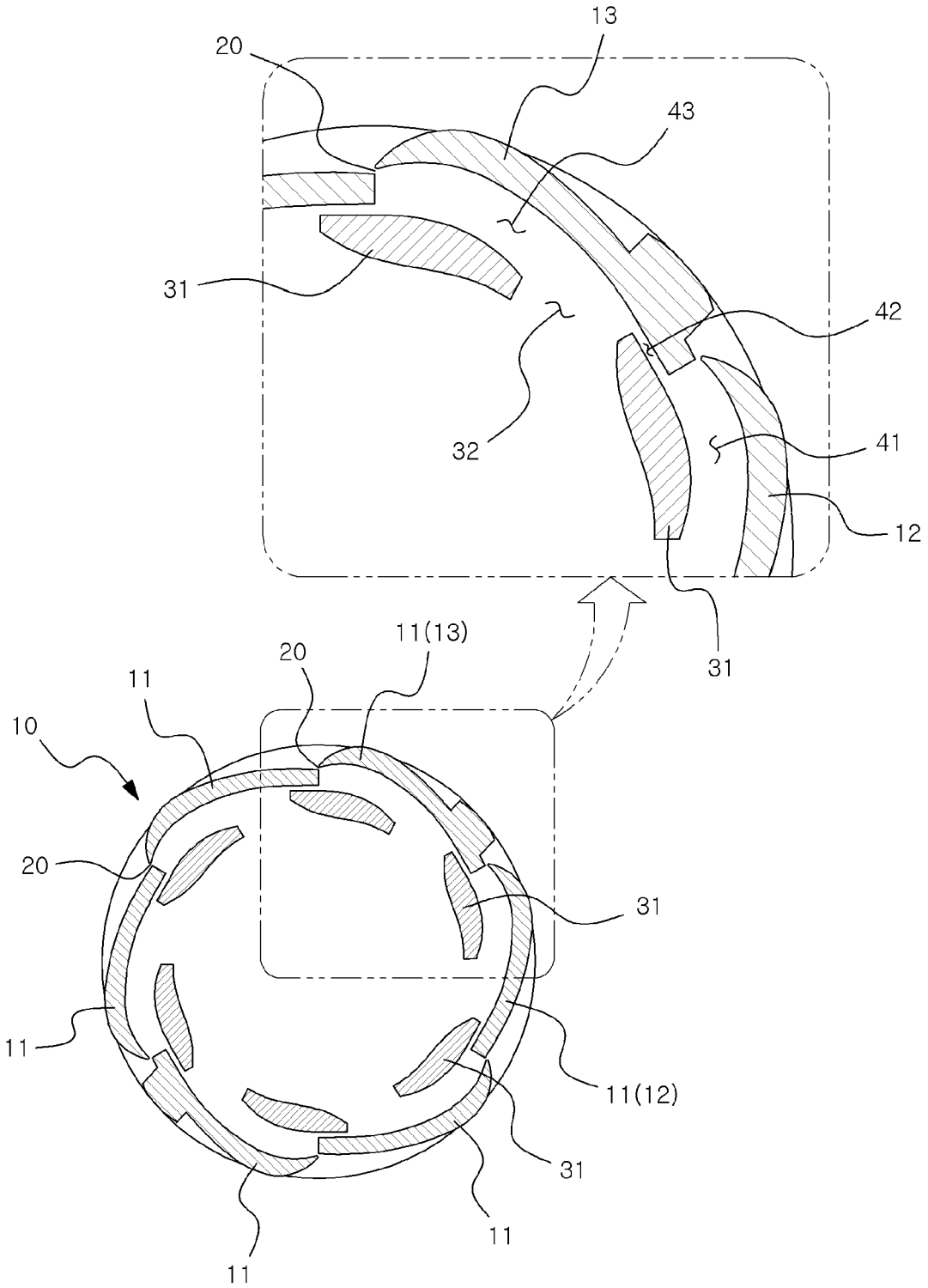
FIG. 4 is a cross-sectional view of the hair curling head illustrated in FIG. 1.

FIG. 4 is a cross-sectional view of the hair curling head illustrated in FIG. 1.

Referring to FIG. 4, the slot 20 is formed between a portion with a relatively high curvature of one plate part 11 and a relatively flat portion of another plate part 11. In the following description, two arbitrary plate parts 11 that are adjacent to each other and form the slot 20 together will be referred to as a first plate part 12 and a second plate part 13. The first plate part 12 and the second plate part 13 are sequentially disposed in a direction in which air is discharged.

The guide plates 31 are configured so that a primary air blowing space 41 is formed between the first plate part 12 and the guide plate 31 and a secondary air blowing space 42 is formed between the second plate part 13 and the guide plate 31.

The primary air blowing space 41 is formed between the guide plate 31 and the first plate part 12 and allows air entering through the air blowing hole 32 to blow and be discharged through the slot 20 between the first and second plate parts 12 and 13.

The secondary air blowing space 42 is formed between the guide plate 31 and the second plate part 13 and is formed to have a space smaller than the primary air blowing space 41. Some of the air of the primary air blowing space 41 blows through the secondary air blowing space 42.

The guide plates 31 has a guide surface formed so that a gap from the second plate part 13 is narrower than a gap from the first plate part 12. The guide surface of the guide plates 31 is disposed to overlap with the second plate part 13 by as much as an area that corresponds to the secondary air blowing space, and due to such a structure, the secondary air blowing space 42 has a smaller volume than the primary air blowing space 41. The secondary air blowing space 42 may also be referred to as an air blowing gap between the second plate part 13 and the guide plate 31 and communicates with a primary air blowing space 43 below the second plate part 13.

Figure 5:
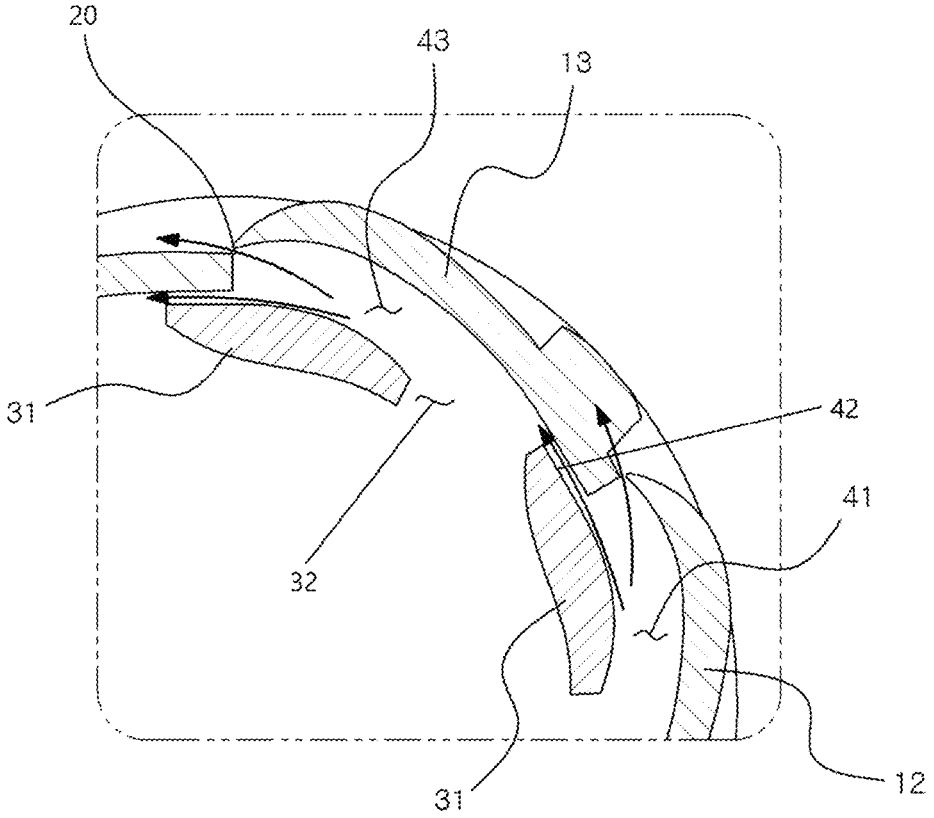
FIG. 5 is an operational state view of the hair curling head illustrated in FIG. 1.

FIG. 5 is an operational state view of the hair curling head illustrated in FIG. 1.

With reference to FIG. 5, in an operational process of the hair curling head 1 according to the present embodiment, air entering through the inlet 17 of the head main body 10 blows to the primary air blowing space 41 below the first plate part 12 through the air blowing hole 32 of the internal insert 30.

For reference, arrows in FIG. 5 indicate directions of air. The air of the primary air blowing space 41 is discharged to the outside of the head main body 10 through the slot 20 between the first and second plate parts 12 and 13. Some of the air of the primary air blowing space 41 blows to the secondary air blowing space 42 and then enters the primary air blowing space 43 below the second plate part 13 and joins the air blowing through the air blowing hole 32. Such an air blowing process identically occurs throughout the entire portion of the internal insert 30 and the head main body 10.

Some of the air blown to a space between the guide plate 31 and the plate part 11 through the air blowing hole 32 is discharged to the outside through the slot 20, and some of the air forms a flow that circulates in the circumferential direction of the internal insert 30 through the secondary air blowing space. In this way, an appropriate volume of air discharged to the outside of the head main body 10 may flow along the surface of the head main body 10.

The air discharged through the slot 20 forms a flow in the circumferential direction and is combined with air discharged through another slot 20 to form a flow along the surface of the head main body 10. Here, the air flowing along the surface is drawn to the curved surface of the head main body 10 due to the Coanda effect, and thus the hair around the head main body 10 is automatically wound around the surface of the head main body 10 and curled.

Here, the guide ribs 35 and the blade parts 15 may distribute the blowing air to make the flow of air uniform and increase the flow velocity and, as a result, may increase a hair suctioning effect.

Figure 6:
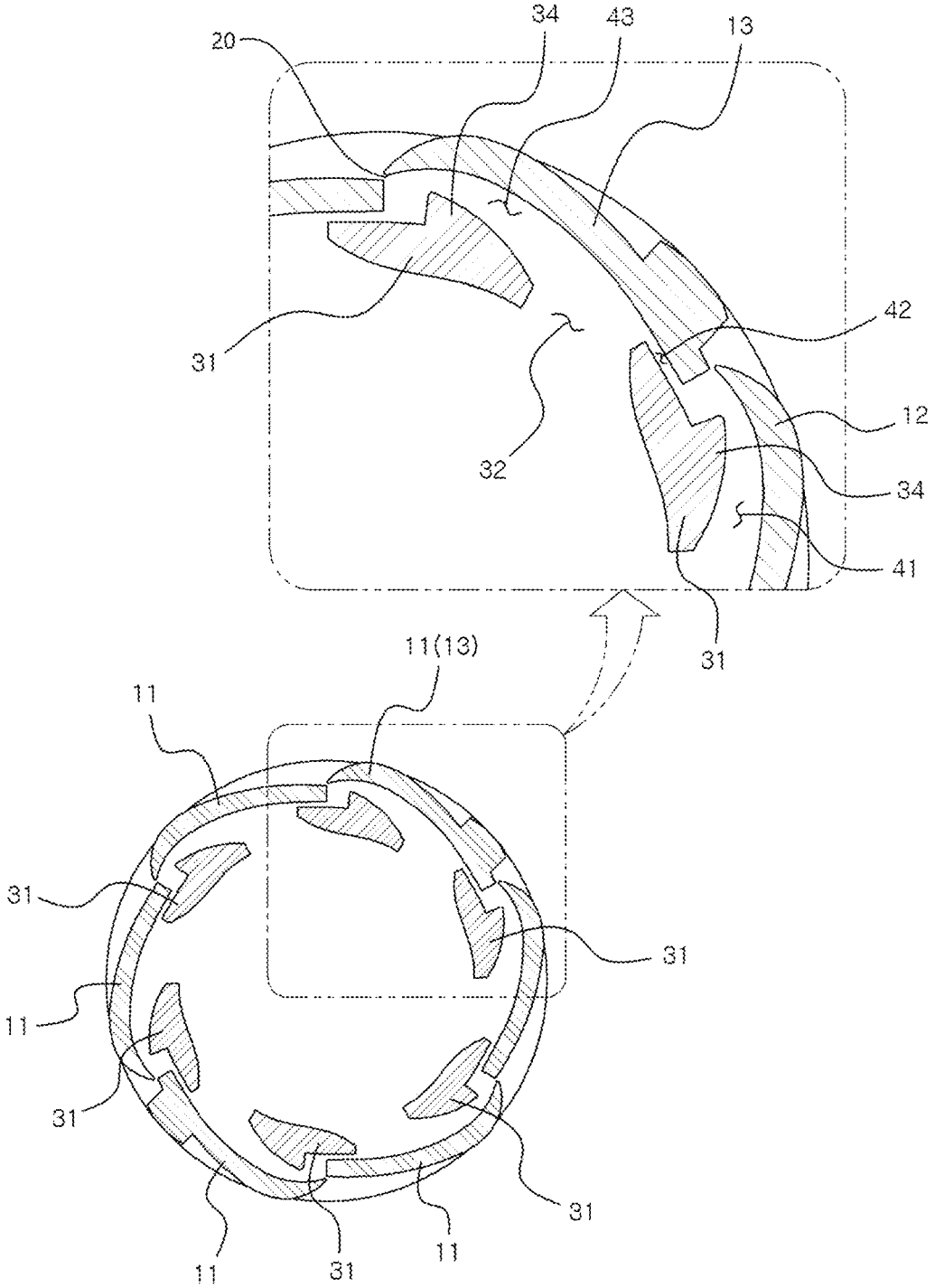
FIG. 6 is a cross-sectional view of a hair curling head according to another embodiment of the present disclosure.
Figure 7:
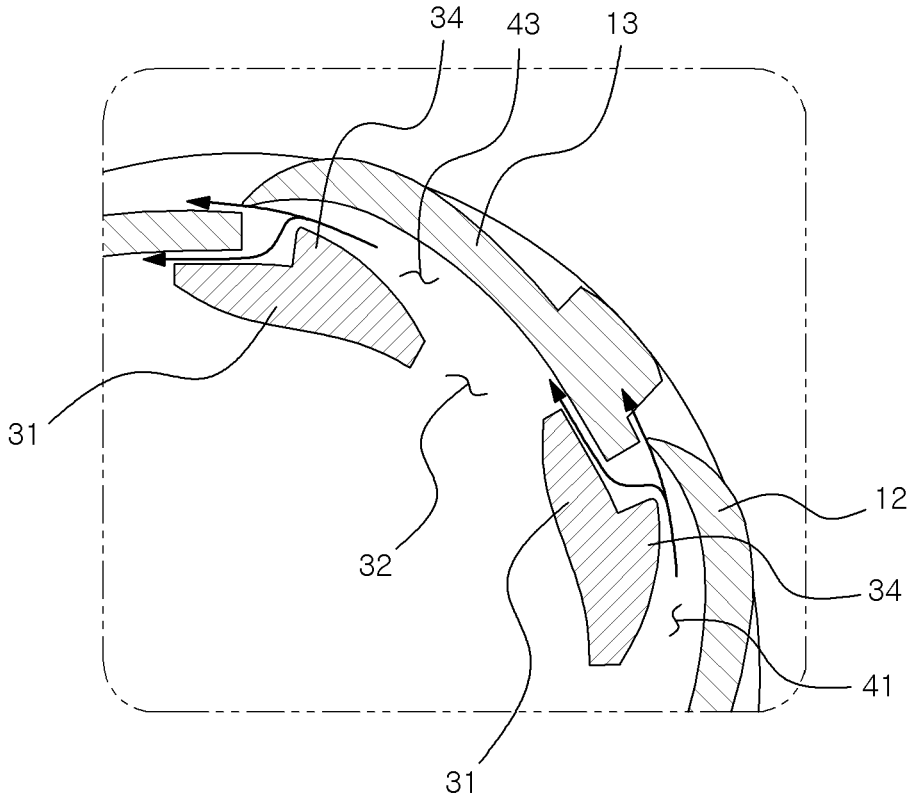
FIG. 7 is an operational state view of the hair curling head illustrated in FIG. 6.

FIG. 6 is a cross-sectional view of a hair curling head according to another embodiment of the present disclosure, and FIG. 7 is an operational state view of the hair curling head illustrated in FIG. 6.

The hair curling head according to the present embodiment basically has the same configuration as the hair curling head according to the previous embodiment and is different therefrom that a guide protrusion 34 is further formed on the guide plates 31.

The guide protrusion 34 is formed to protrude outward from the guide surface of the guide plates 31 and serves to guide the air of the primary air blowing space 41 toward the slot 20. The guide protrusion 34 may have a shape that is curved to be convex outward and may be formed at a position that is spaced a predetermined distance apart from the position of the slot 20 to secure a space through which air enters the secondary air blowing space 42.

The air blowing process is the same as in the previous embodiment. Air which blows to the primary air blowing space 41 of the first plate part 12 and is guided through the guide protrusion 34 is discharged to the outside through the slot 20, and some of the air blows to the secondary air blowing space 42 and enters the primary air blowing space 43 of the second plate part 13.

Figure 8:
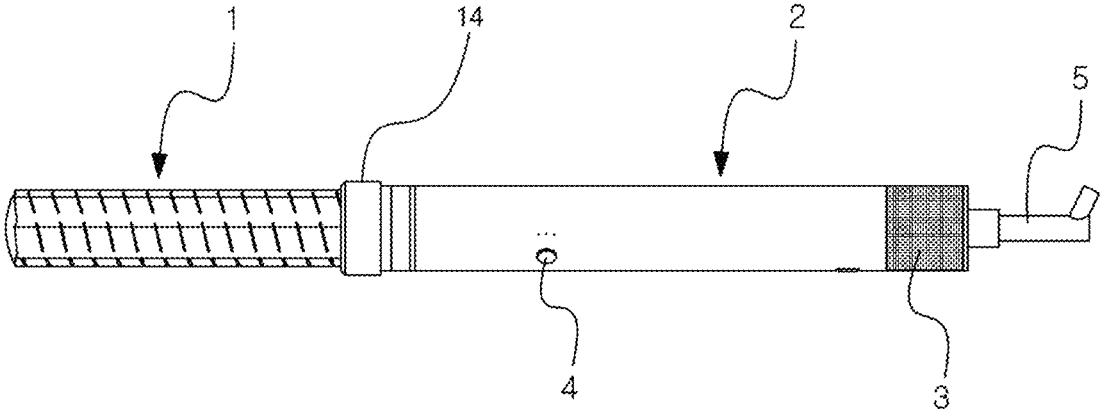
FIG. 8 is a front view of a hair styling device according to one embodiment of the present disclosure.

FIG. 8 is a front view of a hair styling device according to one embodiment of the present disclosure.

As illustrated in FIG. 8, the hair styling device according to the present embodiment includes the handle 2 and the hair curling head 1 which is attachable to the handle 2.

The handle 2 is configured to be gripped by a user's hand and has a fan unit embedded therein to suction and blow air. An inlet 3 through which air enters is formed in the handle 2, and a cable 5 for power supply may be connected to the handle 2. Also, a manipulation button 4 for the user to control the operation may be disposed on an outer surface of the handle 2.

The hair curling head 1 may be detachably installed at the handle 2, and here, the collar 14 of the head main body 10 is coupled to the handle 2. Air which is blown as the fan unit embedded in the handle 2 operates enters the inlet 17 of the head main body 10 and is discharged through the slot 20 of the head main body 10 due to the process described above.

Various different types of hair curling heads 1 may be prepared according to the diameter of the head main body 10 or the number and shape of the slots 20, and the user may choose the hair curling head 1 that suits his or her taste, attach the chosen hair curling head 1 to the handle 2, and then operate the hair styling device.

According to the embodiments of the present disclosure, by the structure that guides a direction of air being discharged to the outside of the slot through the internal insert installed inside the head main body, there is an effect of inducing air to evenly flow in a direction along the surface of the head.

According to such a structure, there is an advantage that, by discharging some of the air blown into the head main body to the outside through the slot and circulating some of the air along an inner surface of the head main body, an appropriate volume of air may flow along the surface of the head main body. Also, there is an advantage that a manufacturing process is simplified due to assembling the head main body and the internal insert, which are produced through a molding process, in order to manufacture the head.

In addition, according to the embodiments of the present disclosure, there is an advantage that, due to a plurality of guide ribs and blade parts formed on the internal insert and the head main body, respectively, to distribute blowing air, a hair suctioning effect is increased, and thus hair curling performance can be improved.

The present disclosure has been described above with reference to specific embodiments thereof, but those of ordinary skill in the art should understand that various modifications and changes may be made within the scope not departing from the spirit and scope of the present disclosure defined in the claims below.

What is claimed is:

1. A hair curling head for a hair styling device, the hair curling head comprising:

a cylindrical head main body which has an inlet through which air enters;

a plurality of slots which are formed in the head main body in a longitudinal direction thereof and distributed in a circumferential direction of the head main body; and an internal insert which is inserted into the head main body and configured to guide air entering through the inlet toward the slots so that the air is discharged through the slots and flows along a surface of the head main body, wherein the internal insert includes:

a plurality of guide plates which are disposed in the circumferential direction; and a frame part which is configured to support the plurality of guide plates so that air blowing holes are formed between the plurality of guide plates, and wherein each guide plate is configured to form:

a primary air blowing space which is formed between the guide plate and an arbitrary first plate part among a plurality of plate parts and which allows air entering through the air blowing holes to blow and be discharged through the slots; and a secondary air blowing space which is formed between the guide plate and a second plate part adjacent to the first plate part and which is formed to have a space smaller than the primary air blowing space to allow some of the air of the primary air blowing space to blow.

2. The hair curling head of claim 1, wherein:

the head main body includes the plurality of plate parts sequentially disposed in the circumferential direction; and the slots are formed between the plurality of plate parts.

3. The hair curling head of claim 2, wherein the plate parts each have the form of a curved panel whose inner surface is concave and outer surface is convex.

4. The hair curling head of claim 1, wherein the guide plates have a guide surface formed so that a gap from the second plate part is narrower than a gap from the first plate part.

5. The hair curling head of claim 1, wherein a guide surface of the guide plate of the plurality of guide plates is disposed to overlap with the second plate part by as much as an area that corresponds to the secondary air blowing space.

6. The hair curling head of claim 1, wherein the air blown to the secondary air blowing space enters the primary air blowing space below the second plate part.

7. The hair curling head of claim 1, further comprising a guide protrusion which is formed to protrude from a guide surface of the guide plates and is configured to guide air of the primary air blowing space toward the slots.

8. The hair curling head of claim 7, wherein the guide protrusion is formed at a position spaced a predetermined distance apart from the position of the slot.

9. The hair curling head of claim 1, further comprising a plurality of guide ribs which are formed on a guide surface of the guide plates and configured to induce air entering through the air blowing holes to be distributed into a plurality of airflows.

10. The hair curling head of claim 9, wherein the guide ribs are formed to be inclined at a certain angle with respect to a longitudinal direction of the internal insert.

11. The hair curling head of claim 1, wherein a plurality of blade parts configured to distribute air discharged through the slots into a plurality of airflows are formed on the head main body.

12. A hair styling device comprising:

a handle which is configured to be gripped by a user's hand and has a fan unit embedded therein to suction and blow air; and a hair curling head which is attached to the handle and configured to discharge air for curling hair according to an operation of the fan unit, wherein the hair curling head includes a cylindrical head main body which has an inlet through which air enters, a plurality of slots which are distributed in the head main body in a longitudinal direction thereof and formed in a circumferential direction of the head main body, and an internal insert which is inserted into the head main body and configured to guide air entering through the inlet toward the slots so that the air is discharged through the slots and flows along a surface of the head main body, wherein the internal insert includes:

a plurality of guide plates which are disposed in the circumferential direction; and a frame part which is configured to support the plurality of guide plates so that air blowing holes are formed between the plurality of guide plates, and wherein each guide plate is configured to form:

a primary air blowing space which is formed between the guide plate and an arbitrary first plate part among a plurality of plate parts and which allows air entering through the air blowing holes to blow and be discharged through the slots; and a secondary air blowing space which is formed between the guide plate and a second plate part adjacent to the first plate part and which is formed to have a space smaller than the primary air blowing space to allow some of the air of the primary air blowing space to blow.

* * * * *